US006347468B1

(12) United States Patent
Mohamed

(10) Patent No.: US 6,347,468 B1
(45) Date of Patent: Feb. 19, 2002

(54) PORTABLE ILLUMINATED SIGN WITH CHANGEABLE MESSAGES

(76) Inventor: Abdulahi Mohamed, 4149 Cambridge Street, Burnaby B.C. (CA), V5C 1G8

( * ) Notice: Subject to any disclaimer, the term of this patent is extended or adjusted under 35 U.S.C. 154(b) by 0 days.

(21) Appl. No.: 09/433,340

(22) Filed: Nov. 4, 1999

(51) Int. Cl.[7] ..... G09F 13/04

(52) U.S. Cl. ..... 40/564; 40/586; 434/408; 116/202; 340/321

(58) Field of Search ..... 40/546, 564, 361, 40/714, 716, 586; 434/408, 421, 417; 116/202; 340/321

(56) References Cited

U.S. PATENT DOCUMENTS

| | | | | | |
|---|---|---|---|---|---|
| 441,863 | A | * | 12/1890 | Bergstein | 40/564 |
| 1,096,448 | A | * | 5/1914 | Murphey | 40/564 |
| 1,986,705 | A | * | 1/1935 | Bernstein et al. | 40/564 |
| 2,566,458 | A | * | 9/1951 | Macau | 40/546 |
| 2,644,935 | A | * | 7/1953 | Greenwald | 40/546 X |
| 3,215,453 | A | * | 11/1965 | Malcom, Jr. | 40/546 |
| 4,340,372 | A | * | 7/1982 | Brassine | 40/546 X |
| 4,587,755 | A | * | 5/1986 | Sunshine | 40/564 |
| 5,001,455 | A | | 3/1991 | Starchevich | |
| 5,276,424 | A | | 1/1994 | Hegemann | |
| 5,454,181 | A | * | 10/1995 | Rothman et al. | 40/564 |
| 5,918,396 | A | | 7/1999 | Jung | |

* cited by examiner

*Primary Examiner*—B. Dayoan
*Assistant Examiner*—Andrea Chop
(74) *Attorney, Agent, or Firm*—Oyen Wiggs Green & Mutala

(57) ABSTRACT

Currently at airports, cruise ship terminals and the like disembarking travellers are met by travel personnel such as travel agents, taxi drivers etc. who have been hired to transport a particular traveller to a destination but do not personally know their target traveller and so display a hand-written sheet or sign with the traveller's name written thereon so that the target traveller will see his/her name and identify himself/herself to the travel personnel. Such greeting signs are often difficult to read due to poor lighting and are unprofessional looking. The present invention provides an illuminated greeting sign on which the greeting message can be easily changed, in particular by using a translucent back-lit panel, illuminated by a battery-powered light, on which erasable marker messages may be written.

10 Claims, 2 Drawing Sheets

PORTABLE ILLUMINATED SIGN WITH CHANGEABLE MESSAGES

TECHNICAL FIELD

The invention relates to the field of portable, illuminated signs, and more particularly to a portable sign on which illuminated changeable messages can be displayed.

BACKGROUND ART

Currently at airports, cruise ship terminals and the like, disembarking travellers are met by travel personnel such as travel agents, taxi drivers etc. who have been hired to transport a particular traveller to a destination but do not personally know their target traveller and so display a hand-written sheet or sign with the traveller's name written thereon so that the target traveller will see his/her name and identify himself/herself to the travel personnel. Such greeting signs are often difficult to read due to poor lighting and are unprofessional looking.

Previous portable illuminated signs are known for various purposes. For example, U.S. Pat. No. 5,001,455 Starevich, issued Mar. 19, 1991, discloses a portable illuminated sign for signalling a taxi. This device has a fixed illuminated message, namely the word "TAXI" and so is not useful for the airport greeting application which requires a changeable greeting message.

There is therefore a need for an illuminated greeting sign on which the greeting message can be easily changed.

DISCLOSURE OF INVENTION

The present invention therefore provides a portable sign on which illuminated changeable messages can be written. The invention provides a portable sign for displaying illuminated changeable messages, comprising a) a hollow housing; b) a light source mounted in the housing; c) a portable power source in the housing for supplying electric power to the light source; and d) a panel adapted to display a changeable message and positioned to be illuminated by the light source. Preferably the panel comprises a light-transmitting material having an erasable surface.

BRIEF DESCRIPTION OF DRAWINGS

In drawings which illustrate a preferred embodiment of the invention.

BEST MODE(S) FOR CARRYING OUT THE INVENTION

Figure 1:
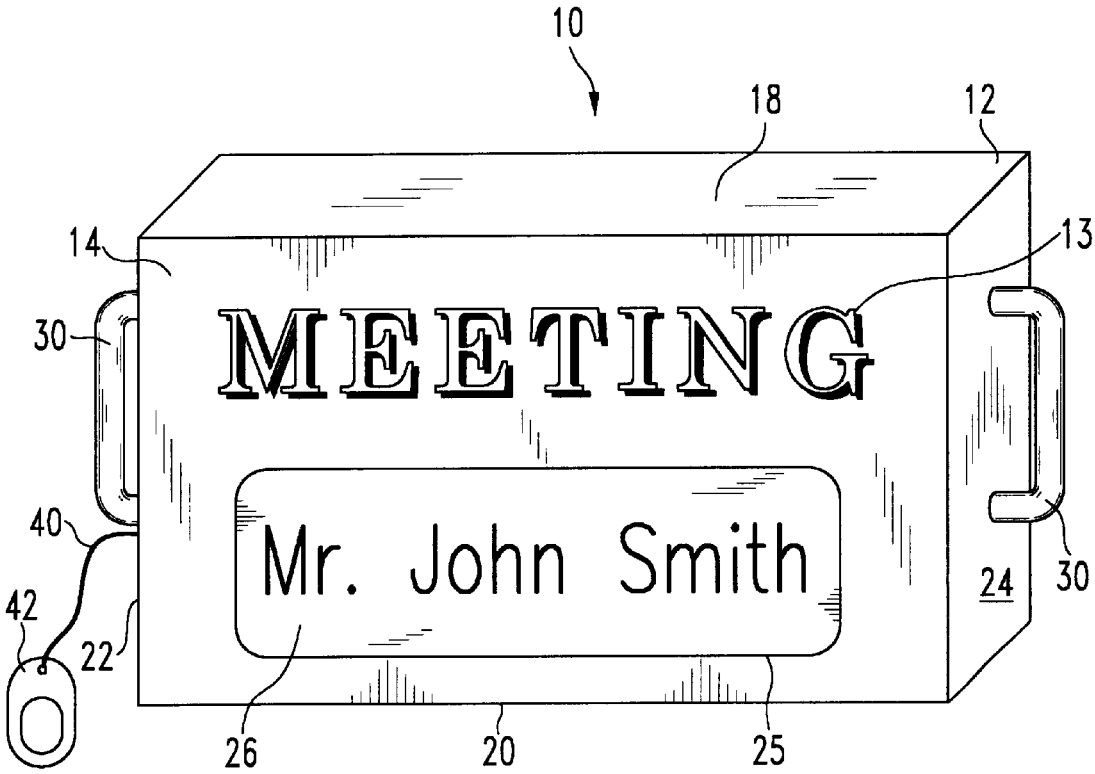
FIG. 1 is a front perspective view of the invention.
Figure 2:
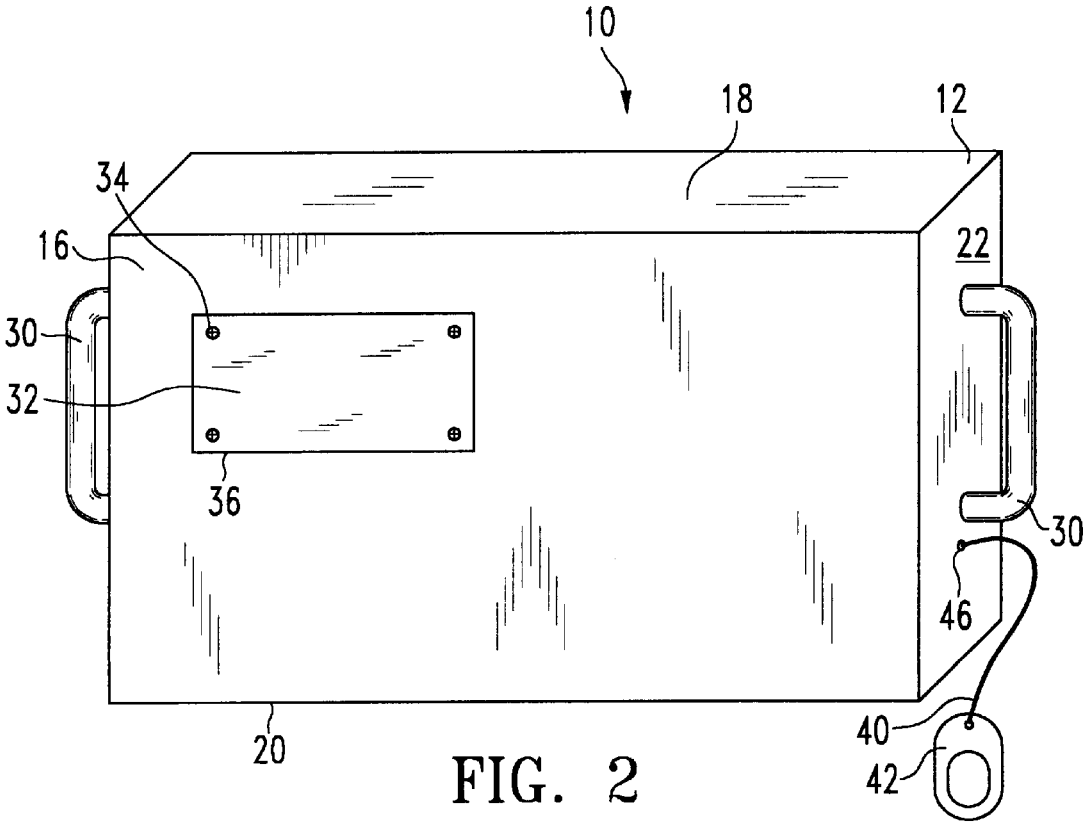
FIG. 2 is a rear perspective view of the invention.
Figure 3:
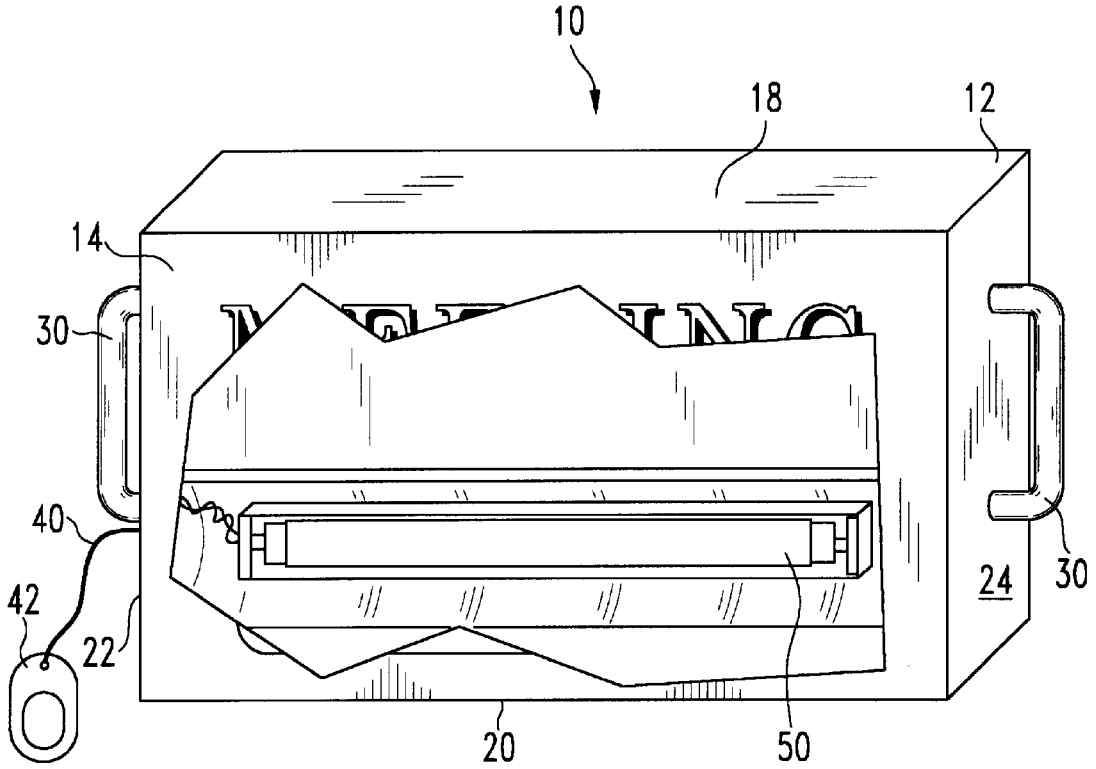
FIG. 3 is a front perspective view of the invention partially cut-away.
Figure 4:
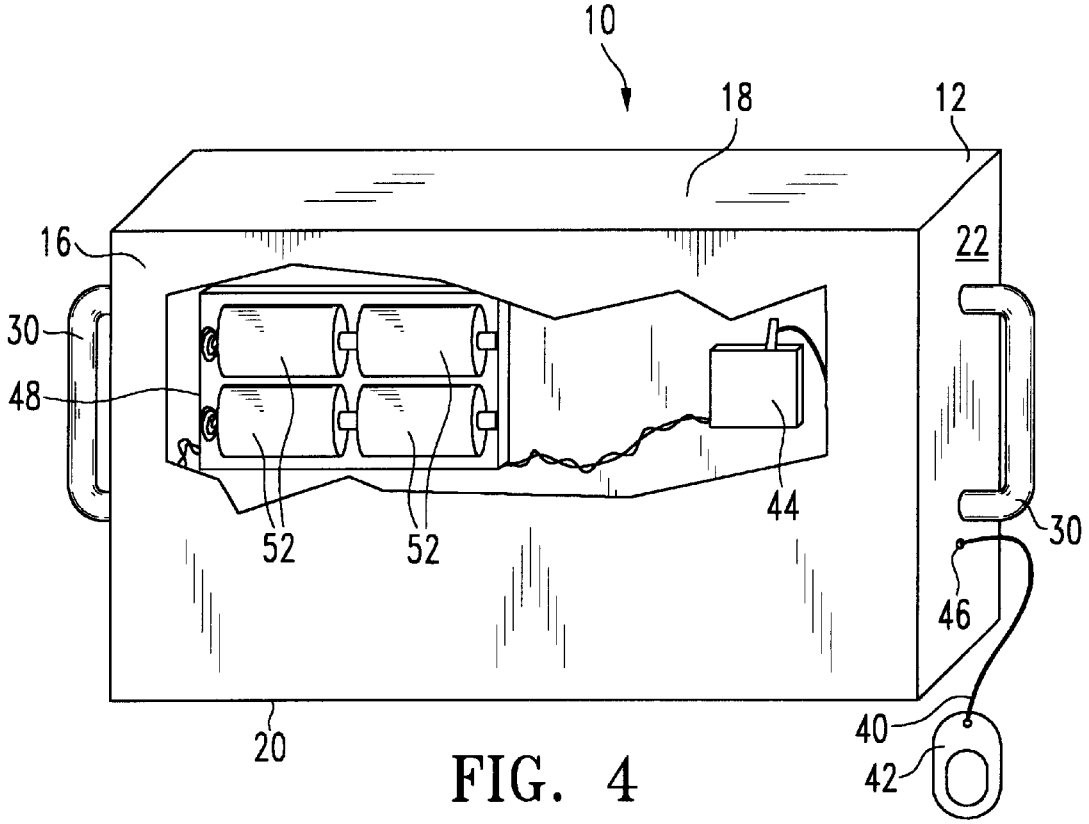
FIG. 4 is a rear perspective view of the invention partially cut-away.

With reference to the drawings, the illuminated sign of the invention is generally designated by reference numeral 10. It consists of a hollow, rectangular plastic housing 12 having a front face 14, rear face 16, top surface 18, bottom surface 20, and side surfaces 22, 24. Housing 12 may be formed of an opaque, hard molded plastic, metal or other similar material. Preferably it has a printed, highly-visible, such as white or luminescent permanent message 13, such as the word "MEETING". The permanent message may also be illuminated by forming appropriate openings in housing 12 covered by coloured light-transmitting plastic and back-lit by a light source as described for the erasable message below. Plastic handles 30 are secured to sides 22, 24 and are sized to be grasped by a user's hand. String 40 has pull ring 42 and is attached to on-off switch 44 through aperture 46.

Front surface 14 is provided with an opening 25 which is covered by a light-transmitting panel 26 which is formed of a plastic with an erasable surface on which a dry erasable marker can apply an erasable marking. Panel 26 is preferably translucent, but a transparent surface also would function. For example a suitable material for panel 26 is a translucent white PLEXIGLAS™. Access panel 32 is removably secured to rear surface 16 by screws 34 to provide access through opening 36 to the interior of housing 12.

The interior of housing 12 is provided with battery receptacle 48, light source 50 and switch 44 and batteries 52, which are preferably 4 D-size 1.5 volt batteries. Light source 50 is preferably a 6 or 9 volt fluorescent tube, with associated ballast but may also be an incandescent light bulb of the type used in flashlights.

In operation, the user writes the name of the target traveller on panel 26 using a dry erasable ink marker, for example of the MAGIC MARKER™ variety, although any erasable ink marker will be useful. The user holds up the sign 10 using handles 30 and pulls string 40 to illuminate panel 26. The attention of the target traveller is now readily drawn to his/her name for locating the travel personnel. For a subsequent meeting with a different traveller, the travel personnel simply wipes off panel 26 and writes on the name of the new traveller.

While the preferred embodiment of the invention uses an erasable panel 26, other illuminated changeable message panels would also be useful in the invention. For example, removable lettering which may be rigid letters held in a lengthwise frame may be used or flexible lettering removably adhered to panel 26 may be used. In those cases, panel 26 could be back-lit or front-lit by lighting around the edge of opening 25. Alternatively panel 26 may be a backlit panel provided with a sufficient number of Light Emitting Diodes which can be programmed by a keypad (not shown) to display the changeable message. Other forms of handles may be used, such as a single post centrally located on the lower surface 20. A rocker switch accessible on the exterior of housing 12 or other pushbutton or throw switch may be used to replace string 40.

As will be apparent to those skilled in the art in the light of the foregoing disclosure, many alterations and modifications are possible in the practice of this invention without departing from the spirit or scope thereof. For example, the present invention, while described for traveller greeting, may also be useful for emergency signalling, roadside accident, restaurant "special of the day", parties, concerts, "car wash" advertising, "open house" or other road side display, in vehicle display such as "new driver" or or other situations where a highly visible, changeable message is desired.

Accordingly, the scope of the invention is to be construed in accordance with the substance defined by the following claims.

What is claimed is:

1. A portable sign for displaying illuminated changeable messages, comprising:

a) a hollow opaque housing having a front surface and provided with an opening in said front surface;

b) a light source mounted in said opaque housing;

c) a portable power source in said housing for supplying electric power to said light source;

d) a panel extending across said opening and adapted to display a changeable message and positioned to be illuminated by said light source wherein said panel comprises a light-transmitting material having an erasable surface;

e) wherein said front surface is further provided with a permanent message located proximate to said opening;

f) switching means for selectively connecting or disconnecting said power source to said light source; and g) a handle secured to said housing for holding said housing in an elevated position.

2. The portable sign of claim 1 wherein said erasable surface is translucent.

3. The portable sign of claim 2 wherein said erasable surface is adapted to receive and have erased therefrom ink markings.

4. The portable sign of claim 2 wherein said erasable surface is a rigid light-transmitting plastic.

5. The portable sign of claim 1 wherein said power source comprises batteries.

6. The portable sign of claim 1 wherein said light source comprises a fluorescent bulb.

7. The portable sign of claim 1 wherein said housing comprises opposed vertical sides and said portable sign comprises handles on each of said vertical sides.

8. The portable sign of claim 1 wherein said housing comprises a lower surface and said handle comprises a single projection centrally located on said lower surface.

9. A portable sign for displaying illuminated changeable messages, comprising:

a) a hollow opaque housing having a front surface and provided with an opening in said front surface;

b) a light source mounted in said opaque housing;

c) a portable power source in said housing for supplying electric power to said light source;

d) a panel extending across said opening and adapted to display a changeable message and positioned to be illuminated by said light source wherein said panel comprises a light-transmitting material and programmable Light Emitting Diodes mounted therein;

e) wherein said front surface is further provided with a permanent message located proximate to said opening; and f) switching means for selectively connecting or disconnecting said power source to said light source.

10. A portable sign for displaying illuminated changeable messages, comprising:

a) a hollow opaque housing having a front surface and provided with an opening in said front surface;

b) a light source mounted in said opaque housing;

c) a portable power source in said housing for supplying electric power to said light source;

d) a panel extending across said opening and adapted to display a changeable message and positioned to be illuminated by said light source wherein said panel comprises a light-transmitting material and further comprises means for attaching removable letters thereto;

e) wherein said front surface is further provided with a permanent message located proximate to said opening; and f) switching means for selectively connecting or disconnecting said power source to said light source.

* * * * *